United States Patent [19]

Silvestri, Jr. et al.

[11] Patent Number: 4,936,002

[45] Date of Patent: Jun. 26, 1990

[54] METHOD OF MODIFYING INTEGRAL STEAM CHEST STEAM TURBINES

[75] Inventors: George J. Silvestri, Jr., Winter Park; Alvin L. Stock, Casselberry, both of Fla.

[73] Assignee: Westinghouse Electric Corp., Pittsburgh, Pa.

[21] Appl. No.: 332,188

[22] Filed: Apr. 3, 1989

[51] Int. Cl.[5] ..... B23P 15/00

[52] U.S. Cl. ..... 29/889.2; 29/401.1; 29/889.1

[58] Field of Search ..... 29/401.1, 156.8 R, 156.4 R, 29/426.1, 428; 415/136

[56] References Cited

U.S. PATENT DOCUMENTS

| | | | |
|---|---|---|---|
| 1,522,191 | 1/1925 | Junggren . | |
| 2,304,993 | 12/1942 | Frank | 253/39 |
| 3,677,658 | 7/1972 | Dinenno, Jr. et al. | 415/108 |
| 3,746,463 | 7/1973 | Stock et al. | 415/136 |
| 3,773,431 | 11/1973 | Bellati et al. | 415/108 |
| 3,913,621 | 10/1975 | Damratowski | 137/630 |
| 4,219,201 | 8/1980 | Straslicka | 277/53 |
| 4,296,538 | 10/1981 | Straslicka | 29/156.4 R |
| 4,592,699 | 6/1986 | Maierbacher | 415/126 |
| 4,692,977 | 9/1987 | Maze | 29/401.1 |
| 4,697,983 | 10/1987 | Yamaguchi | 415/134 |
| 4,702,671 | 10/1987 | Brinkman et al. | 415/134 |

*Primary Examiner*—Mark Rosenbaum

*Assistant Examiner*—Irene Cuda

*Attorney, Agent, or Firm*—K. Bach

[57] ABSTRACT

A method of eliminating cracking between a steam turbine casing and a welded integral steam chest includes removing the integral steam chest from the steam turbine casing and replacing it with a separate and spaced apart steam chest having a plurality of steam exit ports. Steam inlet diffusers located in the turbine casing and normally connected to steam passageways in the integral steam chest are each connected to a corresponding steam exit port in the spaced apart steam chest. The connection between the spaced steam chest and the turbine casing is made by a plurality of relatively flexible steam pipes. Preferably, the integral steam chest is removed by cutting away the welded junction between the turbine and steam chest at a level corresponding to a radially outer end of the inlet diffusers in the turbine casing. The diffusers are each re-bored to a uniform diameter suitable for insertion of the flexible steam pipes. Each steam pipe is then welded to a corresponding diffuser. The separate spaced apart steam chest may be held in its spaced apart relation to the turbine casing by a relatively thin wall support member welded to the turbine casing. Steam control valves are preferably incorporated in each of the steam exit ports of the spaced apart steam chest and coupled to control means for controlling the admission of steam into the turbine casing.

7 Claims, 5 Drawing Sheets

METHOD OF MODIFYING INTEGRAL STEAM CHEST STEAM TURBINES

BACKGROUND OF THE INVENTION

1. Field of the Invention

The present invention relates to steam turbines having integral steam chests, and, more particularly, to a method for modifying such turbines to separate the steam chest from the turbine casing.

2. Description of the Prior Art

A steam turbine for generating utility power includes, inter alia, a steam chest where high pressure steam from a boiler is collected and then admitted through apertures controlled by valves into the turbine casing, where its energy is utilized to rotate a power shaft or rotor. The steam chest is preferably located as close to the turbine as possible to minimize heat loss and pressure drops. Efficiency of the turbine increases with increasing temperature and pressure, but high pressures and temperatures involve inherent problems that turbine designers must address. Turbine casings must be exceedingly strong to withstand high steam pressures, and turbine parts and ancillary equipment subjected to high temperatures must be free to expand and contract with temperature changes. Walls thick enough to withstand the high pressures involved can experience differential thermal expansion due to temperature gradients, resulting in plastic flow and distortion of the turbine casing. Another design problem of high pressure turbines is the difficulty in providing steam-tight seals at the interface between the steam chest and the turbine casing.

There are in present use a number of turbines of a design in which the steam chest is an integral part of the turbine casing. The steam chest is typically a shell-like casting welded directly to the turbine casing. This design of turbines also typically utilizes a cam-driven system to operate the control valves in the steam chest that control admission of steam into the turbine casing.

The integral steam chest design, which incorporates a heavy mass of metal, is subject to severe thermal stresses during load cycling, and serious cracking has occurred at the weld junction between the steam chest and turbine casing. With the large integral mass of metal, a large temperature change, for example, from 1000° F. to 700° F., may occur across the valve seats and across the heavy shell area in a very short distance, due to valve throttling. One way to eliminate the thermal stresses in the thick mass of metal, which stresses are known to cause cracking at the chest to turbine joint, is to reduce the volume of metal at the steam chest connection point. Another proposed solution is to form a dog-bone type joint where the steam chest is welded to the casing. However, it is not believed that modification of the joint will prevent cracking due to thermal stresses unless the mass of metal is reduced to provide flexibility and freedom for differential expansion and contraction.

Another problem with the integral steam chest design that creates stress on turbine hardware is the cam-driven lift system for the control valves in the steam chest. Furthermore, the cams on the cam shaft lift the valves in a fixed sequence, which does not allow for full arc admission at start-up and may result in additional stress. This problem is thoroughly discussed in U.S. patent application Ser. No. 07/257898 filed and assigned to the Westinghouse Electric Corporation, incorporated herein by reference.

Various means of providing flexibility and freedom for thermal expansion and contraction have been discussed in the prior art. U.S. Pat. No. 1,522,191, issued Jan. 6, 1925 to Junggren, discloses a turbine design with a divided structure of parts alleged to have independent radial expansion and contraction from temperature gradients. U.S. Pat. No. 3,746,463, issued July 17, 1973 to Stock et al., proposes to reduce thermal stress with a design having, inter alia, an inner and outer casing, capable of radial movement relative to each other. U.S. Pat. No. 3,677,658, issued July 18, 1972 to Dinenno, also proposes casting the turbine in separate pieces and then bolting them together, thereby obviating the difficulties entailed in casting a complex one-piece unit, and providing a structure in which the components, including the steam chest and the nozzle chamber, have some limited ability to expand and contract relative to the other components. U.S. Pat. No. 4,697,983, issued Oct. 6, 1987 to Yamaguchi, suggests replacement of a 90° nozzle box with a 180° nozzle box and employs a steam inlet pipe with sliding steam-tight connections at either end and a steam-tight flange in the middle. U.S. Pat. No. 3,773,431, issued Nov. 20, 1973 to Bellati et al., discloses multiple-shell turbine casing of welded sheet metal, axially divided, alleged to keep non-uniform deformation forces of the casing away from the guide blade carrier, and has an outer casing with at least one thermally variable lead-through for a steam inlet pipe to an inner casing. U.S. Pat. No. 4,592,699, issued June 3, 1986 to Maierbacher, discloses a clamping assembly for aligning the gas ports of a pair of casings, such as a steam chest and steam turbine casing, and securing them to form a gas-tight seal between the casings which enhances distribution of pressure loads. The assembly utilizes adjustable fasteners which can effect relative lateral displacement between the casings. None of these prior inventions, however, teaches or suggests a solution to the particular problem of how to eliminate thermally generated cracks in steam turbine having integral steam chests.

SUMMARY OF THE INVENTION

Accordingly, it is an object of this invention to provide a method for modifying existing steam turbine systems having integral steam chests, with the end of eliminating thermally generated cracking.

It is another object of the present invention to eliminate thermally generated cracking at joints between a steam turbine and an integral steam chest by eliminating the integral steam chest and substituting a separate flexible steam chest structure.

Another object of the present invention is to provide a method for modifying integral steam chest steam turbines so as to eliminate thermally generated cracking in a manner which minimizes modifications to the steam turbine structure. Still another object of the present invention is to further reduce stress to the turbine system by incorporating an improved cam shaft driven valve system into the control valves for steam admission.

These and other objects, features and advantages are attained with a method which includes cutting off an integral steam chest from a steam turbine just below the crack-prone thermally stressed weld-site; removing the valve seats from the steam turbine steam diffusers; boring the interior diameter of the diffusers to make them cylindrical from end to end; adding a separate steam chest structure with divided cam shaft valve system; supporting the separate steam chest structure on at least two standpipes welded to the turbine casing; connecting the innermost rebored diffusers with the two corresponding exit ports in the separate steam chest structure; and connecting the remaining rebored diffusers to the corresponding exit ports of the separate steam chest structure with additional pipes welded in place at each juncture.

BRIEF DESCRIPTION OF THE DRAWINGS

For a better understanding of the present invention, reference may be had to the following detailed description taken in conjunction with the accompanying drawings in which.

DETAILED DESCRIPTION OF THE DRAWINGS

Figure 1:
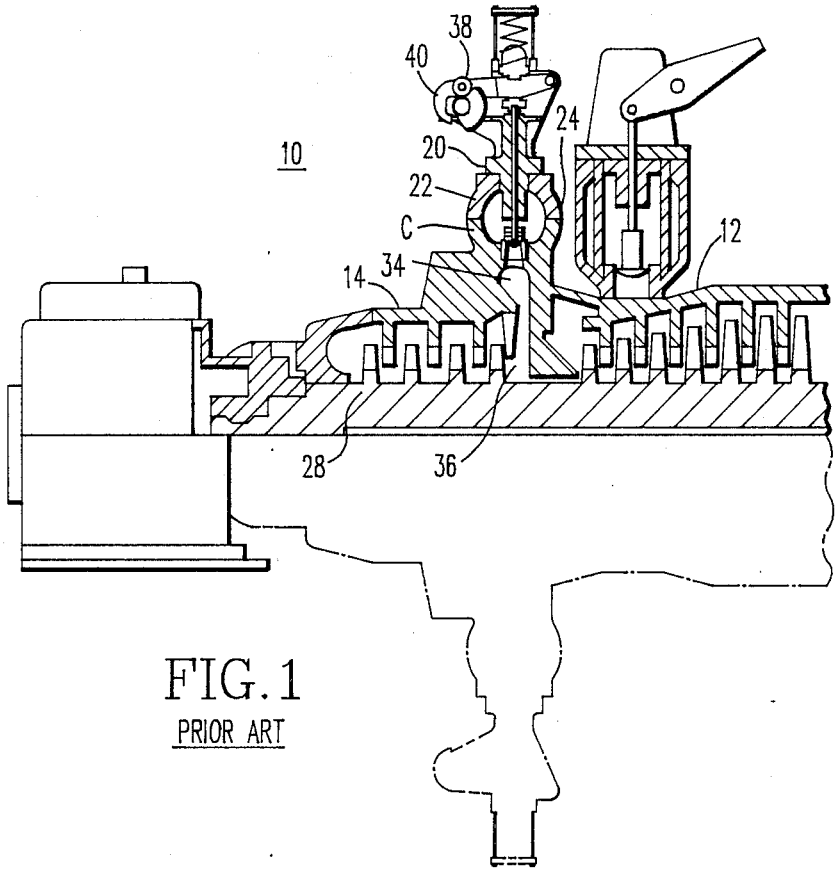
FIG. 1 PRIOR ART
FIG. 1 is a partial cross-sectional view of a steam turbine system utilizing a prior art integral steam chest with cam-driven valve system, taken along the axis of the system.
Figure 2:
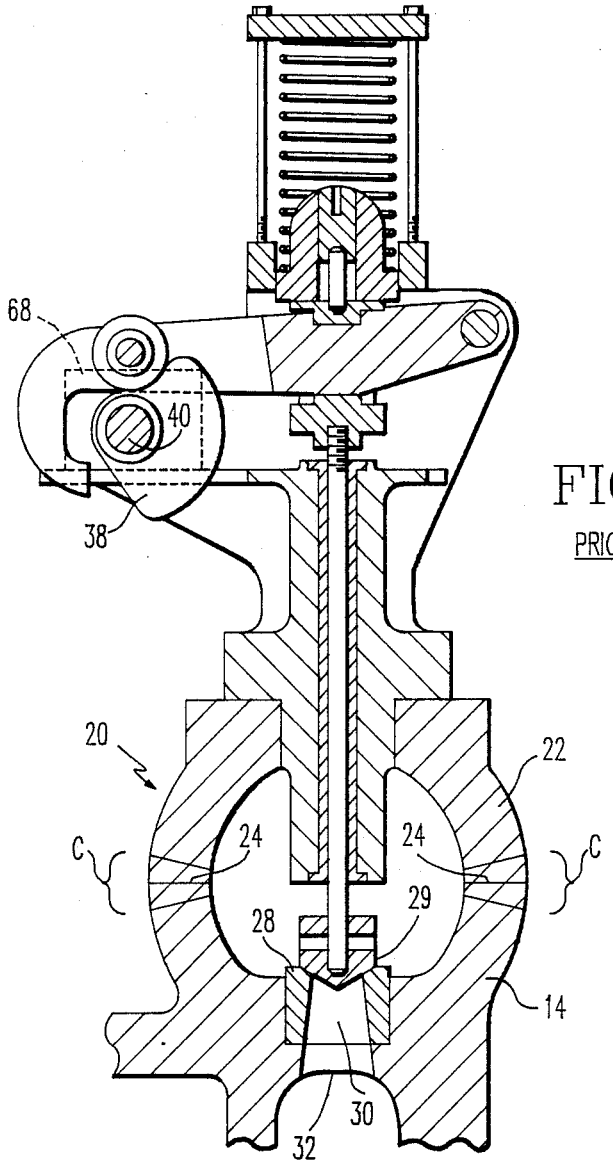
FIG. 2 PRIOR ART
FIG. 2 is an enlarged partial cross-sectional view of the prior art steam turbine casing, steam chest and valve system shown in FIG. 1 taken at the welded joint.

Referring to the drawings and particularly to FIGS. 1 and 2, a prior art steam turbine with integral steam chest, indicated generally at 10, is shown in partial cross-section. Turbine 10 includes a turbine casing 12 having a top wall 14 and an integral steam chest 20 having a wall 22 continuous with turbine wall 14. Steam chest wall 22 is welded to turbine wall 14 at weld site or interface 24. In operation, high pressure steam from a boiler (not shown) is coupled through appropriate steam pipes and a throttle valve (not shown) to steam chest 20. It then passes through a plurality of exit ports 30 into diffusers 32. Each exit port 30 is preceded by a valve seat 28 and a valve member 29 mounted therein, controlling the flow of steam therethrough. The diffusers 32 lead to the turbine nozzle inlet area 34, where the steam is directed toward the first stage of turbine blading 36. The valve members 29 are opened and closed by cams 38 rotated by a cam shaft 40. The area at which thermally generated cracking occurs is indicated by arrow C.

Figure 3:
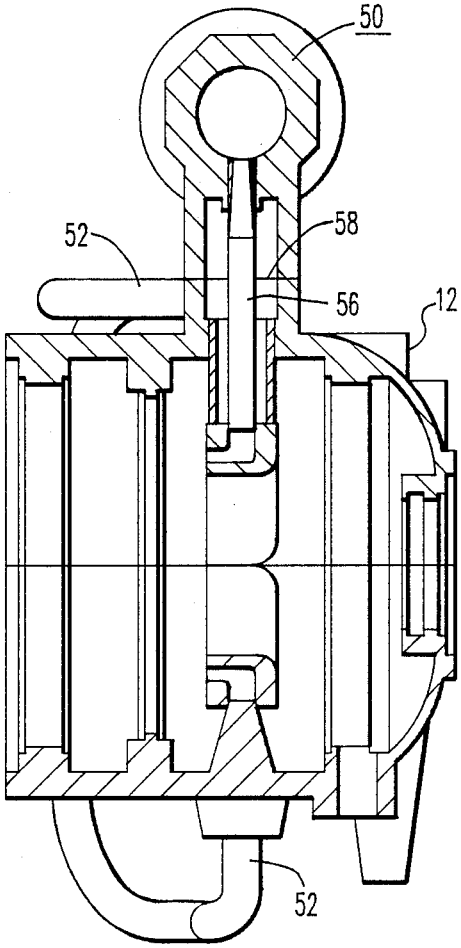
FIG. 3 is a partial cross-sectional view of a modified steam turbine structure incorporating one form of the present invention, taken along the axis of the turbine.
Figure 4:
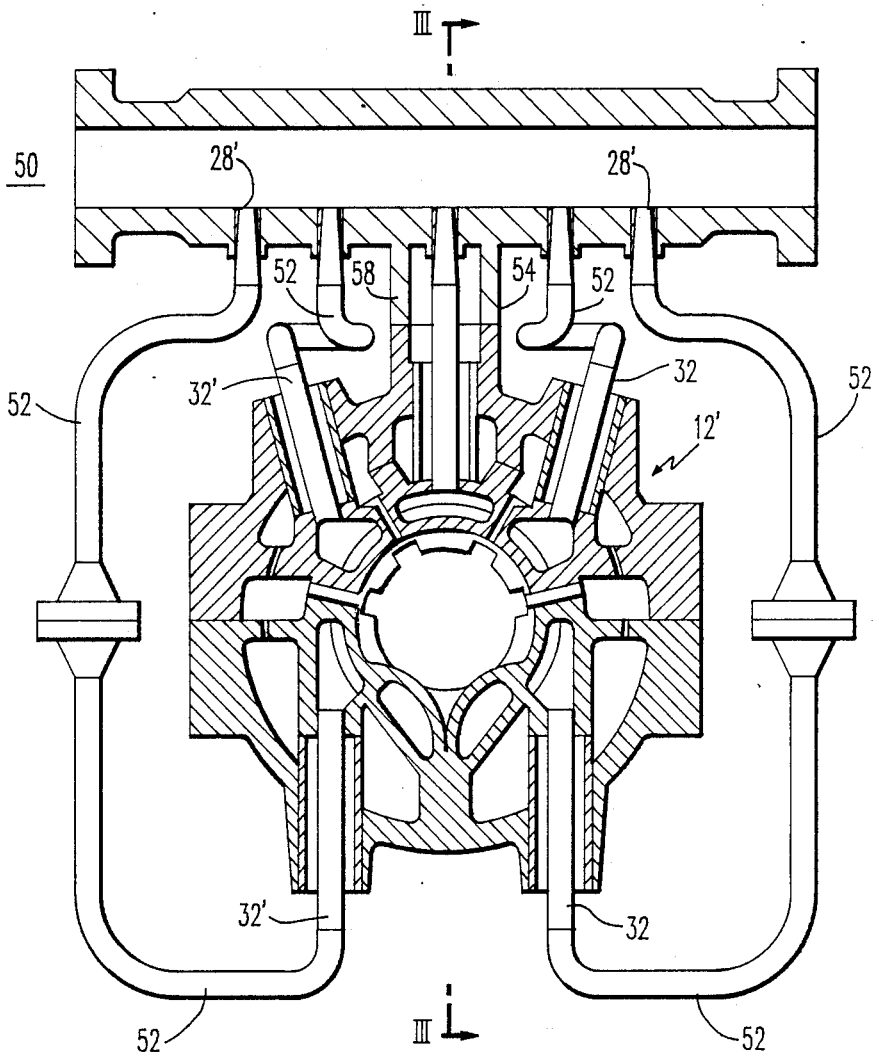
FIG. 4 is a partial cross-sectional view of the modified steam turbine structure of FIG. 3 taken transverse to the axis of the steam turbine.

FIGS. 3 and 4 are partial longitudinal and cross sections, respectively, of a steam turbine with a nonintegral replacement steam chest 50 welded into place in accordance with the teaching of the present invention. Diffusers 32 have been bored to an interior cylindrical shape. Pipes 52 have been inserted into the diffuser openings and welded to the turbine wall 14. The pipes 52 connect the steam chest 50 in spaced apart relation to the turbine casing 12. The steam chest 50 includes a relatively thin wall support member 54 surrounding a centered steam pipe 56. Support member 54 is welded to wall 14 of turbine 10 at weld site 58. The illustrative turbine includes five partial-arc nozzle chambers although any number can be accommodated by changing the number of pipes 52 connecting to steam chest 50. Each nozzle chamber is separately connected to steam chest 50 by one of the relatively flexible pipes 52 or by pipe 56.

In forming the modified steam chest structure of FIGS. 3 and 4, the prior steam chest wall 22 is cut away from wall 14 to separate the chest 20 from turbine 10. The wall 14 is then machined off flush with the external end of the diffusers 32. Each diffuser opening is then bored to a uniform diameter to eliminate any flow restriction. Pipes 52 or 56 are then inserted into the diffuser openings and welded to the turbine wall 14. Each pipe 52 is then connected to the separated steam chest 50. Control valve members 59, equivalent to valve members 29, are located in steam chest 50 and positioned over corresponding ones of the pipes 52. Each pipe 52 includes a valve seat 28' for mating with valve members (not shown). The valve members are opened and closed to control steam flow to turbine 10 in a manner described hereinafter.

Figure 5:
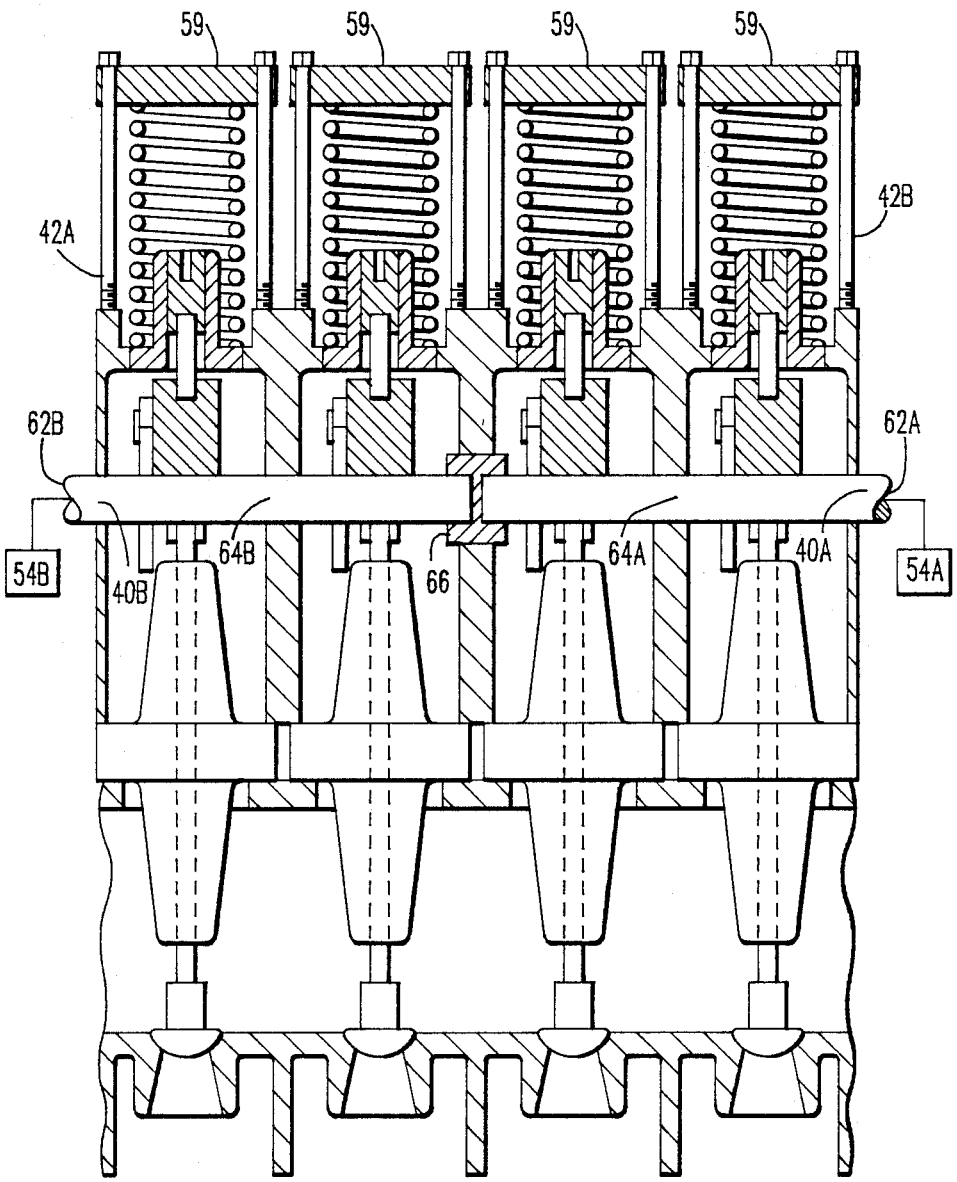
FIG. 5 is a partial cross-sectional view of a modified steam chest incorporating a split cam actuation system, taken transverse to the axis of the steam turbine.

As illustrated in FIG. 5, a method of improving the efficiency (heat rate) and performance of a steam turbine of the type having multiple, commonly operated control valves is to separate the common shaft 40 into at least two sections 40A and 40B to form the two cam actuation sections 42A, 42B. The partial-length shaft sections 40A and 40B may divide the control valves so that for the illustrative five valve system of FIG. 4, one cam shaft section 40A controls two of the control valves 59 while the other cam shaft section 40B controls three valves 59. While FIG. 5 illustrates an equally divided four valve system, the application of the arrangement to a five valve system of the type shown in FIG. 4 will be readily apparent. Each shaft section 40A and 40B is operated by a separate shaft actuator 54A and 54B, respectively. Each outer end 62A, 62B of shafts 40A, 40B is supported in the manner of the prior art system of FIG. 1. The inner ends 64A, 64B of shafts 30A, 30B are supported in a double-ended support 66. The support 66 is attached to the frame 68 (see FIG. 2A) through which shaft 30 normally passes and which supports the shaft for rotation. The support 66 may use bushings or roller bearings (not shown) to support shaft ends 64A, 64B. By appropriately controlling the valves 59, shock loading of the turbine can be reduced thus lessening the stress on the steam chest to turbine connections and further reducing the likelihood of cracking at the joints.

While only certain preferred features of the invention have been shown by way of illustration, many modifications and changes will occur to those skilled in the art. For example, other methods may be used to support the chest 50 on turbine 10 in substitution for the support member 54. Furthermore, other valve actuation systems may be used to control the steam control valves, such as, for example, individually driven control valves. It is, therefore, to be understood that the present claims are intended to cover all such modifications and changes which fall within the true spirit and scope of the invention.

What is claimed is:

1. A method of eliminating cracking between a steam turbine casing and an integral steam chest welded thereto, the integral steam chest having a plurality of steam passageways communicating with a corresponding number of steam inlet diffusers in the casing, the method comprising the following steps of:

removing the integral steam chest from said steam turbine casing;

replacing the integral steam chest with a separate and spaced apart steam chest having a plurality of steam exit ports; and connecting each exit port of the separate and spaced apart steam chest to a corresponding inlet diffuser in the turbine casing by means of a plurality of relatively flexible steam pipes.

2. The method according to claim 1 wherein the step of removing the integral steam chest comprises cutting away the welded junction of the integral steam chest to turbine casing at a level corresponding to a radially outer end of the inlet diffusers.

3. The method of claim 2 and including the step of boring each inlet diffuser to a uniform diameter suitable for insertion of the steam pipes therein.

4. The method of claim 3 and including the step of welding each steam pipe to the corresponding diffuser.

5. The method according to claim 1 further comprising the step of supporting the separate and spaced apart steam chest in spaced apart relation to the casing by a relatively thin wall support member welded to the turbine casing.

6. The method of claim 1 and including the steps of:

placing a steam control valve in each steam exit port of the separate and spaced apart steam chest;

coupling at least part of the valves to control means independent of the control means of the remainder of the valves; and operating the control means to vary the valve positioning for smooth transition between different partial-arc operating conditions.

7. The method of claim 6 wherein the control means comprises cam actuating means, the step of operating including the step of selectively actuating the cam actuating means to control valve position.

* * * * *